United States Patent [19]

Dorleans

[11] Patent Number: 4,822,302

[45] Date of Patent: Apr. 18, 1989

[54] FASTENING MEANS FOR A MOTOR VEHICLE LAMP

[75] Inventor: Guy Dorleans, Boulogne, France

[73] Assignee: Cibie Projecteurs, Bobigny, France

[21] Appl. No.: 97,949

[22] Filed: Sep. 17, 1987

[30] Foreign Application Priority Data

Sep. 18, 1986 [FR] France ..... 86 13087

[51] Int. Cl.[4] ..... H01R 13/74

[52] U.S. Cl. ..... 439/544; 362/226

[58] Field of Search ..... 439/544, 568; 362/226, 362/267

[56] References Cited

U.S. PATENT DOCUMENTS 4,500,946 2/1985 Mikola ..... 362/226

4,682,274 7/1987 Freudenreich et al. ..... 362/226 X

FOREIGN PATENT DOCUMENTS 2107165 5/1972 France .

2466701 4/1981 France .

2528535 12/1983 France .

*Primary Examiner*—Eugene F. Desmond

[57] ABSTRACT

A device for locking a lamp in the socket of a motor vehicle headlight, the lamp including a flange (16) suitable for coming into abutment against an annular surface (34) of the socket for putting the lamp in a predetermined axial position, the lamp and the socket including complementary fittings (18, 36) for putting the lamp in a predetermined angular position, the device being characterized in that it comprises a ring (50), assembly means (42, 56; 70, 56) enabling the ring to be permanently assembled to the socket in such a manner as to allow it to rotate relative to the socket through a predetermined angle, the ring including a circular inside passage (52) having a diameter equal to or slightly greater than the outside diameter of the lamp's flange, and in that complementary radial fittings (19, 54) are provided at the periphery of the flange (16) and in the passage (52) in such a manner that, in a first angular position of the ring, the lamp may be inserted therethrough up to the predetermined axial and angular position, and that, in a second angular position, the lamp is held in said position by said fittings (54).

7 Claims, 2 Drawing Sheets

FASTENING MEANS FOR A MOTOR VEHICLE LAMP

FIELD OF THE INVENTION

The present invention relates in general manner to fastening and locking motor vehicle headlight lamps in corresponding sockets or bases, and it relates more particularly to a device for locking a lamp in a motor vehicle headlight socket, said lamp including a flange suitable for bearing against an annular surface of the socket for predetermined axial positioning of the lamp, the lamp and the socket including complementary fittings for predetermined angular positioning of the lamp.

BACKGROUND OF THE INVENTION

The prior art, and in particular French Pat. Nos. 1 192 040, 1 442 908, 2 099 977, 2 147 471, 2 359 369, and 2 411 361, already describes locking devices in which an element in the form of a hat, cap, ring or the like and optionally co-operating with a spring serves to lock a vehicle headlight lamp when the lamp occupies an appropriate axial and angular position within its socket. However, in all of these prior art locking devices, lamp replacement, or any other operation on a lamp, requires said locking element to be removed, and therefore runs the risk of it being mislaid by the user.

The present invention seeks to alleviate this drawback and provides a locking device including a locking element which remains permanently attached to the headlight without hindering the insertion and the extraction of the lamp.

Another aim of the invention is to provide a device which facilitates the positioning of the lamp in its proper angular orientation when it is being put into place.

SUMMARY OF THE INVENTION

According to the present invention, the locking device comprises a ring, assembly means enabling the ring to be permanently assembled to the socket in such a manner as to allow it to rotate relative to the socket through a predetermined angle, the ring including a circular inside passage having a diameter equal to or slightly greater than the outside diameter of the lamp's flange, and complementary radial fittings being provided radially at the periphery of the flange and in the passage in such a manner that, in a first angular position of the ring, the lamp may be inserted therethrough up to the predetermined axial and angular position, and that, in a second angular position, the lamp is held in said position by said fittings.

BRIEF DESCRIPTION OF THE DRAWINGS

The invention will be better understood from reading the following detailed description of preferred embodiments thereof, which description is given by way of example and with reference to the accompanying drawings, in which.

DESCRIPTION OF PREFERRED EMBODIMENTS

Figure 1:
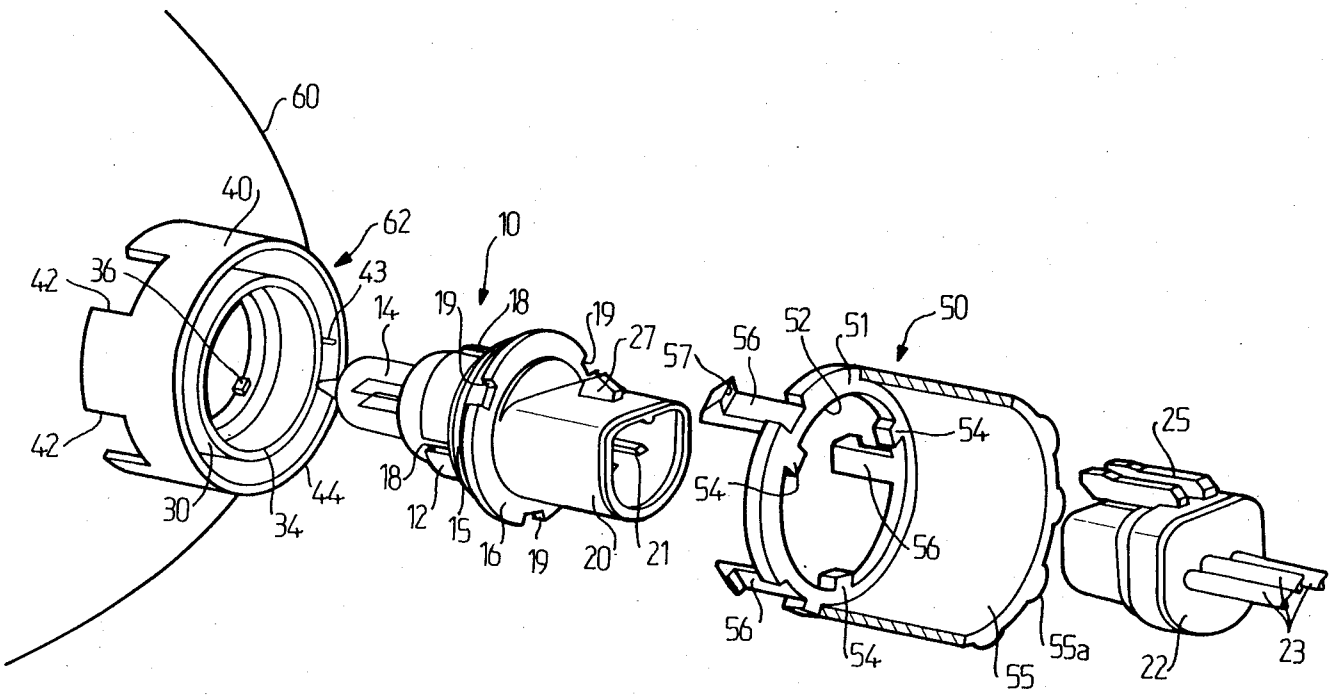
FIG. 1 is a partially cutaway exploded perspective view of a device in accordance with a first embodiment of the invention.

With reference initially to FIG. 1, a device in accordance with a first preferred embodiment of the invention is intended to releasably fasten a lamp 10 in an associated base or socket given an overall reference 62 and provided at the back of the housing 60 of a motor vehicle headlight.

The lamp 10 comprises a body 12 and a bulb 14. The lamp 10 is positioned relative to the headlight in an axial direction by the surface of a flange 16 which is at least partially annular and which projects radially from the body 12 of the lamp coming into abutment against an annular surface 34 constituted by the rearr end of a first inner collar 30 of the socket 62. In addition, the angular position of the lamp relative to the headlight is set by one or more studs 36 formed inside said inner collar 30 coming opposite and penetrating into a corresponding number of complementary radial notches 18 formed in the body 12 of the lamp in front of the flange 16. In the present example, these studs and notches are three in number, and they are preferably disposed irregularly around the periphery of the lamp and of the associated circular passage through the housing. In this way, they also serve as keying means for preventing incorrect positioning of the lamp.

The lamp further includes a sealing ring 15 received in a groove of rectangular section (not visible) and intended, when the lamp is in place in the socket, for co-operating with the inside wall of the collar 30 in order to seal the inside of the headlight from its environment appropriately. The sealing ring 15 is advantageously made of an appropriate elastomer material.

In addition, the annular flange 16 has three notches 19 made in the periphery thereof, which are rectangular in shape, which are irregularly distributed, and which serve for purposes described below.

Finally, in a rear region thereof, the lamp includes a sleeve 20 of substantially D-shaped cross-section with lamp connection pins 21 extending longitudinally from the end thereof. An associated connector 22 connected to cables 23 is suitable for being inserted into the sleeve in such a manner as to establish electrical connection with the lamp. Means (referenced 25 and 27) for providing locking by elastic deformation are provided on the sleeve and on the connector in order to provide mutual dismountable fastening.

The socket also includes an outer collar 40 which is coaxial with the inner collar 30 and which has three openings 42 (only two of which are visible) provided therein and angularly offset at different intervals relative to one another. These openings are rectangular in shape, are adjacent to the housing, and have their respective rear edges situated at a predetermined distance from the annular face at the rear end 44 of the outer collar 40. In this respect, it may be observed that said annular face 44 is offset axially rearwardly relative to the end face 34 of the inner collar 30 by a distance which is substantially equal to or slightly greater than the thickness of the lamp flange 16, for reasons explained below.

When the housing 60 is made by molding, the inner and outer collars 30 and 40 are advantageously integrally molded as a single piece together with the housing.

The locking device per se comprises a ring 50 which is generally cylindrical in shape and whose outside diameter is substantially equal to the outside diameter of the outer collar 40. The base 51 of the ring (i.e. its end directed towards the housing 60) includes a circular opening 52 whose diameter is slightly greater than the outside diameter of the lamp flange 16. Three studs 54 are formed on the periphery of the opening 52. They are rectangular in shape and slightly smaller than the notches 19 provided on the lamp, and they are angularly disposed at locations which correspond to said notches.

In addition, the ring 50 includes three tabs 54 which extend forwardly from the base 51 surrounding the circular opening 52 at angular positions which correspond to the openings 42 in the outer collar 40. The ends of the tabs have respective latching portions 57 which are disposed at a distance from the base 51 which is substantially equal to the above-mentioned predetermined distance between the openings 42 in the collar 40 and the end surface 44 thereof. In addition, each of the tabs is substantially narrower than the width of each associated opening, and by way of non-limiting example each is approximately half as wide in the present embodiment.

Finally, for handling purposes, the ring includes a grasping portion 55 which, in the present embodiment, is tubular and has outwardly directed splines 55*a*. This portion also serves to protect the sleeve 20 of the lamp and of the connector 22 which it houses. Naturally, the grasping portion 55 could have any other shape.

The above-described device is used as follows.

Initially, in the absence of the lamp 10 and its connector 22, the ring 50 is mounted on the rear of the housing 60 by applying axial thrust to said ring while it occupies a predetermined angular position. By virtue of radially outward elastic deformation, the tabs 56 then penetrate between the collars 30 and 40, and their latching portions then latch onto the rear edges of the openings 42. The ring 50 is thus permanently connected to the headlight and cannot easily be disassembled therefrom by the user, and is thus difficult to lose. The assembly of the ring on the headlight can be called "permanent" in that in order to disassemble them it is necessary to apply inwardly directed radial pressure simultaneously on each of the tabs 56 so as to overcome the associated latching effect, and this can only be done by means of a special tool.

As mentioned above, the sizes of the tabs 56 and the associated openings 42 are chosen so that in this situation the ring is connected to the socket with substantially no axial play while still being capable of pivoting relative thereto through an angle which is defined by the side edges of the openings 42.

In addition, the positions of the studs 54 on the ring 50 are such that when the ring 50 is turned to its anti-clockwise end position, the lamp 10 may be inserted in its socket. More precisely, the angular orientation which must be given to the lamp in order to allow its flange 16 to pass through the circular opening 52 of the ring (so that the studs 54 and the notches 19 come into mutual engagement) is identical to the predetermined angular orientation which the lamp must take up in its socket, as determined by the studs 36 and the notches 18.

Once the lamp has been inserted inside the socket, the rear surface of the flange 16 is level with the rear surface 44 of the outer collar 40. The ring can then be turned clockwise manually to bring the studs 54 over the flange 16 instead of being opposite the associated noteches 19, and the lamp is thus held firmly in place.

Preferably (but not shown) each stud 54 may include a projection on its front face directed towards the flange, e.g. a slope or the like, which is intended to eliminate or at least to progressively reduce any axial play of the lamp during the above-described locking operation.

Depending on the type of lamp used, the above-mentioned elastomer sealing ring 25 may be suitable for establishing radial sealing by virtue simply of the lamp being put into place, or else for providing axial sealing against a step, or else for providing sealing against a frustoconical seat provided in the socket. In the latter two cases, the above-mentioned projections or slopes serve to compress the sealing ring appropriately.

The lamp is disassembled by performing the above operations in the reverse order.

Preferably, a middle spline or the like is provided in a region of at least one of the portions 42 or 70 which cooperate with the tabs 56 (as shown at 43 in FIGS. 1 and 2) such that when the ring 50 passes from the locking position to the unlocking position it is necessary to go past a stiff point. In this way, the ring is prevented from turning accidentally to its unlocking position which could allow the lamp to move accidentally rearwardly.

Figure 3:
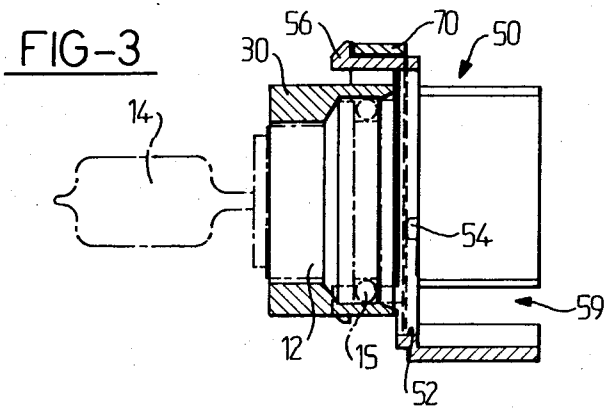
FIG. 3 is a longitudinal vertical section through the FIG. 2 device in the assembled position, with the lamp being locked.
Figure 2:
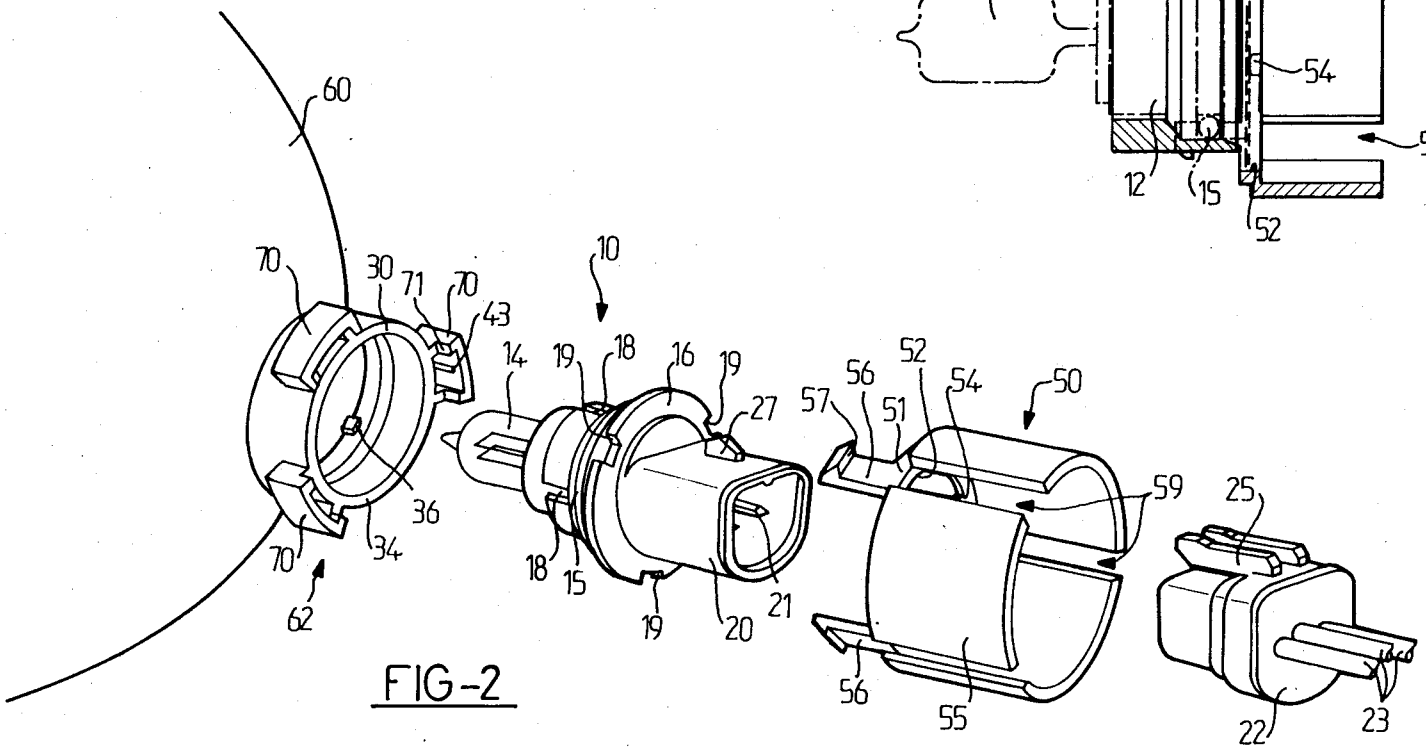
FIG. 2 is an exploded perspective view of a device in accordance with a second embodiment of the invention.

FIGS. 2 and 3 show a variant embodiment of the invention. In these figures, items or parts which are identical or similar to those shown in FIG. 1 have been designated by the same reference numerals.

As can be seen, the collar 30 has three external cages 70 each of which is suitable for receiving an associated tab 56 of the ring 50. In practice, this solution makes it possible to omit the outer collar 40.

In addition, the tubular portion 55 of the ring 50 includes three longitudinal slots aligned with the tabs 56, essentially for facilitating unmolding thereof. These slots also serve to replace the grasping splines 55*a* of FIG. 1 for facilitating turning the ring in order to lock and to unlock the lamp.

As can also be observed, the axial offset which was provided between the rear end surfaces 34 and 44 of the collars 30 and 40 in FIG. 1 in order to receive the annular flange 16 on the lamp, is replaced in this case by an offset 71 provided in the radial direction substantially halfway between the inside and the outside walls of each cage.

The locking device of this second embodiment of the invention is used in essentially the same way as is the first embodiment.

It should be observed that the present invention is particularly applicable to two-filament lamps in accordance with American "Motor Vehicle Safety Standard No. 108" having characteristics identical to those described above and shown in the drawings. However it is also applicable to any lamp including similar arrangements for being held in the appropriate position in the headlight and for being locked therein.

Naturally, the present invention is not limited in any way to the embodiments described above and shown in the drawings, and the person skilled in the art can make any variations or modifications thereon in accordance with the spirit of the invention and without going beyond its scope.

In particular, although the case envisaged has the socket 62 formed on the housing of the headlight, the socket could equally well be formed on the reflector thereof.

I claim:

1. A device for locking a lamp in the socket of a motor vehicle headlight, the lamp including a flange suitable for bearing against a annular surface of the socket for predetermined axial positioning of the lamp, the lamp and the socket including first complementary fittings for predetermined angular positioning of the lamp whereat the lamp is fixed against rotation, said device comprising a ring, assembly means enabling the ring to be permanently assembled to the socket in such a manner as to allow it to rotate relative to the socket through a predetermined angle, the ring including a circular inside passage having a diameter equal to or slightly greater than the outside diameter of the lamp's flange, and second complementary fittings being provided radially at the periphery of said flange and in said passage in such a manner that, in a first angular position of the ring, the lamp may be inserted there through up to the predetermined axial and angular positiion, and that, in a second angular position, the lamp is held in said position by said second complementary fittings.

2. A device according to claim 1, wherein the permanent assembly means for the ring include a set of tabs provided on the ring, extending axially from the periphery of said passage, and terminating in latching portions.

3. A device according to claim 2, wherein the ring is initially mounted on the socket by said tabs resiliently snap-fastening in openings formed in a collar which is fixed to th socket and which surrounds the socket.

4. A device according to claim 2, characterized in that the ring is initially mounted on the socket by said tabs resiliently snap-fastening in cages formed on the outer periphery of the socket.

5. A device according to claim 1, wherein said second complementary fittings comprise three studs formed on the ring and projecting inwardly into said passage, and three notches whose shapes and positions are complementary thereto and which are formed in the periphery of the flange of the lamp.

6. A device according to claim 5, wherein the studs and the notches are angularly disposed in an irregular manner.

7. A device according to claim 1, wherein the ring includes a tubular grasping portion which, when the lamp is in place, surrounds a sleeve provided at the rear of said lamp for receiving a connector.

* * * * *